United States Patent [19]

Sugie et al.

[11] 4,361,129

[45] Nov. 30, 1982

[54] IGNITION SYSTEM FOR INTERNAL COMBUSTION ENGINES

[75] Inventors: Osamu Sugie, Handa; Takasi Hachiga, Kariya; Michio Iyoda, Aichi, all of Japan

[73] Assignee: Nippondenso Co., Ltd., Kariya, Japan

[21] Appl. No.: 203,222

[22] Filed: Oct. 31, 1980

[30] Foreign Application Priority Data

Nov. 6, 1979 [JP] Japan ..... 54-154474[U]

[51] Int. Cl.[3] ..... F02P 3/04

[52] U.S. Cl. ..... 123/622; 123/651; 123/655; 315/209 T

[58] Field of Search ..... 123/621, 622, 643, 644, 123/655, 651, 652; 315/209 T, 206

[56] References Cited

U.S. PATENT DOCUMENTS 3,016,477 1/1962 Naborowski ..... 123/652
3,910,247 10/1975 Hartig ..... 123/655
4,167,928 9/1979 Pagel ..... 123/643
4,262,647 4/1981 Torii et al. ..... 123/651

*Primary Examiner*—Charles J. Myhre
*Assistant Examiner*—Andrew M. Dolinar
*Attorney, Agent, or Firm*—Cushman, Darby & Cushman

[57] ABSTRACT

A contactless ignition system for internal combustion engines of the type including an ignition coil with two primary windings whose primary currents are alternately switched on and off by two power transistors, further includes two Zener diodes each having a breakdown voltage of 300 to 400 volts and connected in series with one of the power transistors and one of the ignition coil primary windings to function as a reverse current blocking diode. By virtue of two series circuits each including the Zener diode, a diode connected in inverse parallel with one of the power transistors and the primary winding, each of the Zener diodes serves both the reverse current blocking function and the overvoltage protection function. The Zener diodes may be replaced with diodes of the avalance type.

6 Claims, 3 Drawing Figures

IGNITION SYSTEM FOR INTERNAL COMBUSTION ENGINES

BACKGROUND OF THE INVENTION

The present invention relates to a contactless ignition system for internal combustion engines, which includes an ignition coil having two primary windings whose primary currents are alternately switched on and off by means of two power transistors.

In a known ignition system of the above type, a reverse current blocking diode is connected between each of the primary windings of an ignition coil and each of two power transistors each having a diode connected in inverse parallel therewith, whereby when one of the power transistors is turned off, the current is prevented from flowing back to the primary winding connected in series with the other power transistor. However, in addition to these diodes, a Zener diode must be connected between the collector and emitter or the collector and base of each of the power transistors to protect the transistor against excessive voltages.

Thus, the known ignition system of the above type has the disadvantage of requiring a large number of component parts and being high in cost due to the connection of a reverse current blocking diode and an overvoltage protection Zener diode to each of two power transistors.

SUMMARY OF THE INVENTION

With a view to overcoming the foregoing deficiencies in the prior art, it is the object of the present invention to provide an improved ignition system for internal combustion engines, which includes a smaller number of component parts and hence has less danger of causing troubles and is lower in cost than previously.

To accomplish the above object, the improved ignition system provided in accordance with the present invention preferably includes two Zener diodes each used in place of a reverse current blocking diode connected in series with each of two power transistors and each of the two primary windings of an ignition coil and the resulting two series circuits each including the Zener diode, a diode connected in inverse parallel with the power transistor and the primary winding are utilized such that each of the Zener diodes serves both the reverse current blocking function and the overvoltage protection function.

DESCRIPTION OF THE PREFERRED EMBODIMENT

The present invention will now be described in greater detail with reference to the illustrated embodiment.

Figure 1:
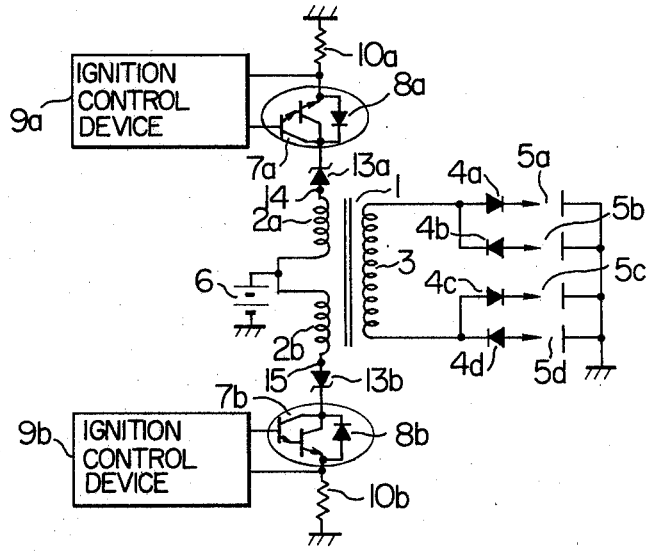
FIG. 1 is a circuit diagram showing an embodiment of an ignition system according to the present invention.

Referring to FIG. 1, numeral 1 designates an ignition coil including two primary windings 2*a* and 2*b* wound in the same direction and having substantially the same number of turns and a single secondary winding 3, and the junction of one end of the primary windings 2*a* and 2*b* is connected to the positive terminal of a battery 6 whose negative terminal is connected to the ground. The other ends of the primary windings 2*a* and 2*b* are respectively connected to the collectors of power transistors 7*a* and 7*b* through Zener diodes 13*a* and 13*b* each comprising for example the TOSHIBA 15FC11 (silicon diffused-junction diode). In accordance with the present invention, the Zener diodes 13*a* and 13*b* may for example be comprised of constant voltage diodes such as avalanche diodes, and in the specification these types of diodes are generically referred to as "Zener diodes". The emitters of the power transistors 7*a* and 7*b* are respectively connected to the ground through current sensing resistors 10*a* and 10*b*. Connected respectively in inverse parallel relation with the collector-emitter paths of the power transistors 7*a* and 7*b* are diodes 8*a* and 8*b* formed integrally with the power transistors 7*a* and 7*b* in the form of integrated circuits. In the present embodiment, the power transistors 7*a* and 7*b* and the diodes 13*a* and 13*b* which are in the form of semiconductor chips (pellets) are respectively encapsulated and placed in a single casing. On the other hand, the secondary winding 3 of the ignition coil 1 has its ends respectively connected to high-voltage diodes 4*a*, 4*b* and 4*c*, 4*d*. The diodes 4*a* and 4*b* are connected in inverse parallel relation and the other diodes 4*c* and 4*d* are similarly connected with each other. The other end of the diodes 4*a* to 4*d* are respectively connected to spark plugs 5*a*, 5*b*, 5*c* and 5*d* which are fitted into the respective engine cylinders. Numerals 9*a* and 9*b* designate ignition control devices for alternately turning on and off the power transistors 7*a* and 7*b* for every ignition cycle.

With the construction described above, the operation of the embodiment is as follows. Assuming that the power transistor 7*a* is turned on by the ignition control device 9*a*, a current flows to the primary winding 2*a* and then this transistor 7*a* is turned off by the ignition control device 9*a* at the ignition time. When this occurs, a high voltage is induced by the mutual induction so that when the polarities at the ends of the secondary windings 3 change, e.g., when the polarities at the upper and lower ends, respectively, become positive and negative, the high-voltage diodes 4*a* and 4*d* are forward biased and a spark is produced at the spark plugs 5*a* and 5*d*, thus allowing the spark plug in one of the cylinders which is on the compression stroke to explode the air-fuel mixture.

On the other hand, similarly the current flows to the other primary winding 2*b* when the other power transistor 7*b* is turned on by the ignition control device 9*b* and then the transistor 7*b* is turned off by the ignition control device 9*b* at the ignition time. As a result, the primary current now flows in the opposite direction to the previously mentioned one, with the result that the ends of the secondary winding 3 have the opposite polarities to those which prevailed previously and consequently the high-voltage diodes 4*b* and 4*c*, for example, are forward biased. When this occurs, a spark is produced at the spark plugs 5*b* and 5*c*, respectively, and the mixture is exploded by the spark plug in one of the cylinders which is on the compression stroke.

Figure 2:
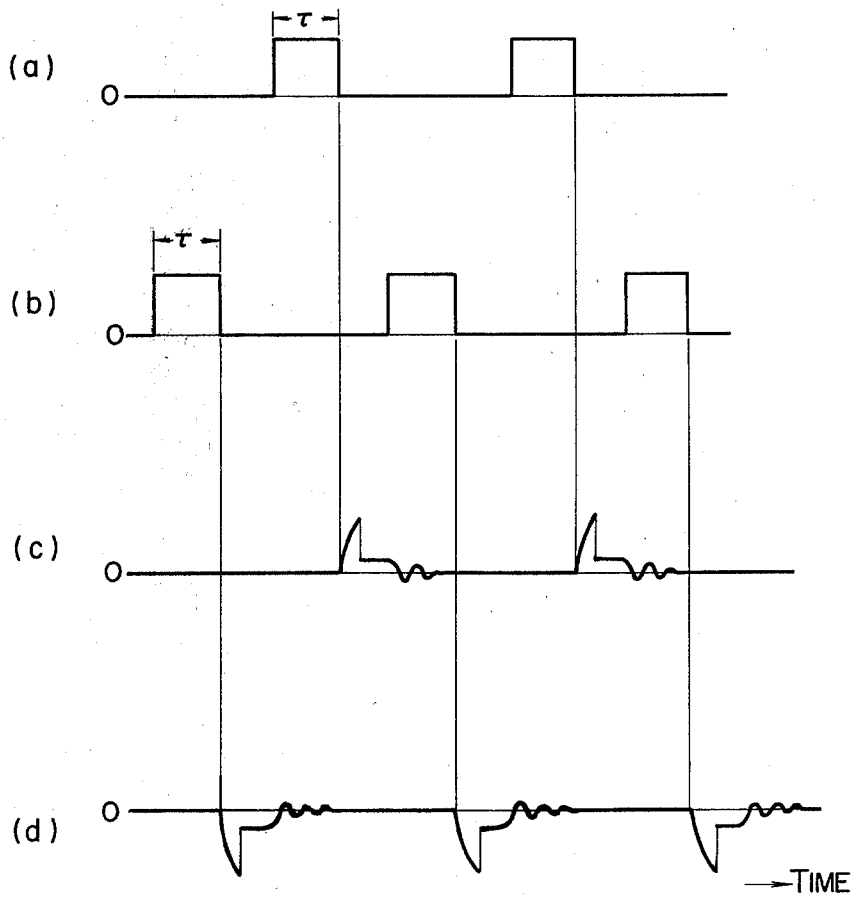
FIG. 2 shows a plurality of waveforms which are useful in explaining the operation of the system shown in FIG. 1.

FIG. 2 shows a plurality of waveforms generated at the various points in the system shown in FIG. 1, with (a) showing the base voltage waveform of the power transistor 7*a*, and (b) the base voltage waveform of the power transistor 7*b*. Shown in (c) and (d) of FIG. 2 are the secondary voltage waveforms produced at the upper end of the secondary winding 3 when the power transistors 7*a* and 7*b* are respectively turned off.

Assuming that during the OFF period of the power transistor 7*b* the other power transistor 7*a* is first turned on and then it is turned off after the expiration of a time $\tau$, a negative voltage is induced at a point 15 in the primary circuit and this negative voltage is clipped to −350 to −400 volts by the breakdown voltage of the Zener diode 13*b* which is, for example, in the range of 350 to 400 volts. Thus, only a positive voltage of 350 to 400 volts is induced by the mutual induction between the primary windings 2*a* and 2*b* at a point 14 opposite to the point 15 and the induced voltage does not become high enough to harm the power transistor 7*a*, thus protecting the power transistor 7*a* against excessive voltages by means of the Zener diode 13*b*. Also, when the potential at the point 15 becomes negative so that a reverse current flows from the ground by way of the built-in diode 8*b* of the transistor 7*b*, the Zener diode 13*b* serves the function of cutting off the reverse current until its breakdown, thus supplying a high-efficiency secondary voltage. The same occurs when the other power transistor 7*b* is turned on and off and the Zener diode 13*a* serves both the function of protecting the power transistor 7*b* against excessive voltages and the function of blocking the reverse current, thus making possible the elimination of two Zener diodes used exclusively for power transistor protecting purposes as in the prior art systems and thereby making it possible to provide an inexpensive ignition system.

Figure 3:
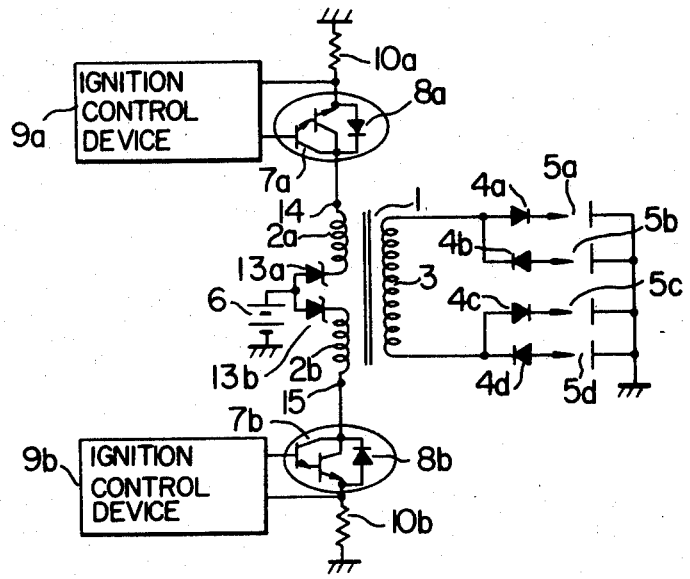
FIG. 3 is a circuit diagram showing an alternative embodiment of an ignition system according to the present invention.

In FIG. 1, the connecting positions of the Zener diodes 13*a* and 13*b* are not limited to the illustrated ones and they may respectively be connected in series and in forward polarity relation with the primary windings 2*a* and 2*b* and the power transistors 7*a* and 7*b* i.e., between battery 6 and the primary windings, respectively as shown in FIG. 3.

Further, while in accordance with the above-described embodiment the present invention is applied to an ignition system having no distributor such that the primary current flow in the primary windings 2*a* and 2*b* is alternately switched on and off by the power transistors 7*a* and 7*b* for every ignition cycle and the resulting high voltages in the secondary winding 3 are suitable distributed to the spark plugs 5*a* to 5*d* through the high-voltage diodes 4*a* to 4*d*, the present invention may be applied to an ignition system of the high frequency ignition type such that at the ignition time the primary current in the primary windings 2*a* and 2*b* is continuously and alternately switched on and off at a high frequency by the power transistors 7*a* and 7*b* and the resulting high frequency voltages in the secondary winding 3 are applied to the spark plugs through the distributor.

We claim:

1. An ignition system for internal combustion engines comprising:

an ignition coil having two primary windings whose one ends are connected to each other and a secondary winding;

a DC power supply having two terminals, one of said terminals being connected to a junction point of said primary windings;

two power transistors each thereof having a collector-emitter path connected between the other terminal of said DC power supply and the other end of associated one of said primary windings;

two diodes each thereof being connected in inverse parallel with the collector-emitter path of associated one of said power transistors;

two ignition control devices each thereof being connected to a base of associated one of said power transistors such that said power transistors are alternately turned on and off;

two constant voltage diodes having the same predetermined breakdown voltage, each of said diodes being connected in series and in forward polarity relation with associated one of said primary windings and associated one of said power transistors; and a high voltage circuit including a plurality of spark plugs connected to said secondary winding.

2. An ignition system according to claim 1, wherein each of said constant voltage diodes is connected between the associated primary winding and the associated power transistor.

3. An ignition system according to claim 1, wherein each of said constant voltage diodes is connected between the associated primary winding and said one terminal of said power supply.

4. An igntion system according to claim 1, wherein said constant voltage diodes are Zener diodes.

5. An ignition system according to claim 1, wherein said constant voltage diodes are avalanche diodes.

6. An ignition system according to claim 2, 3, 4 or 5, wherein the breakdown voltage of said constant voltage diodes is approximately 350 to 400 volts.

* * * * *